US005189435A

United States Patent [19]

Yarsunas et al.

[11] Patent Number: 5,189,435

[45] Date of Patent: Feb. 23, 1993

[54] RETRACTABLE MOTORIZED MULTIBAND ANTENNA

[75] Inventors: George D. Yarsunas, Vincentown; Michael L. Brennan, Howell; Frank Duggan, Trenton, all of N.J.

[73] Assignee: Radio Frequency Systems, Inc., Marlboro, N.J.

[21] Appl. No.: 642,195

[22] Filed: Jan. 16, 1991

[51] Int. Cl.[5] ..... H01Q 1/10

[52] U.S. Cl. ..... 343/903; 343/901; 343/715

[58] Field of Search ..... 343/903, 715, 900, 901, 343/906, 711, 712, 713, 714

[56] References Cited

U.S. PATENT DOCUMENTS

| | | | |
|---|---|---|---|
| 4,323,902 | 4/1982 | Hussey et al. | 343/903 |
| 4,591,868 | 5/1986 | Cusey et al. | 343/903 |
| 4,658,260 | 4/1987 | Myer | 343/903 |
| 4,675,687 | 6/1987 | Elliott | 343/903 |
| 4,734,704 | 3/1988 | Nakase et al. | 343/715 |
| 4,748,450 | 5/1988 | Hines et al. | 343/820 |
| 4,847,629 | 7/1989 | Shimazaki | 343/715 |
| 4,875,053 | 10/1989 | Harada | 343/715 |

FOREIGN PATENT DOCUMENTS

| | | | |
|---|---|---|---|
| 436406 | 7/1991 | European Pat. Off. . | |
| 0127404 | 7/1984 | Japan | 343/711 |
| 86/00471 | 1/1986 | World Int. Prop. O. . | |
| 86/06216 | 10/1986 | World Int. Prop. O. . | |

*Primary Examiner*—Michael C. Wimer
*Assistant Examiner*—Tan Ho
*Attorney, Agent, or Firm*—Ware, Fressola, van der Sluys & Adolphson

[57] ABSTRACT

A retractable motorized multi-band antenna is adapted to receive signals in the AM/FM bands and to receive and transmit signals in a significantly higher frequency band such as that used for cellular telephone. In order to transfer the coaxial input signal to an output coaxial connector, a slip ring connector is provided. The slip ring connector is impedance matched to the antenna to create low VSWR at RF frequencies.

28 Claims, 14 Drawing Sheets

26A
66A
22A
24A
64A
72A
74A
68A
81A
80A
84A
76A
78A
82A
70A
18
19
62A

RETRACTABLE MOTORIZED MULTIBAND ANTENNA

BACKGROUND OF THE INVENTION

1. Field of the Invention

The present invention relates to vehicular antennas and more particularly to retractable antennas adapted to receive AM/FM radio signals and to receive and transmit higher-frequency signals, such as cellular telephone signals.

2. Description of the Prior Art

Cellular telephone service is becoming exceedingly popular and is very much in demand. Since cellular telephones operate in a frequency band considerably higher than the normal AM/FM radio, separate cellular telephone antennas must be installed on vehicles. Initially the existence of the cellular antenna on a vehicle was a status symbol but it is now considered a pretentious display that is to be avoided by those in the service industry. Automobile owners dislike the unsightly objects extending from their vehicles and the need for multiple feed cable holes in the vehicle's exterior for body mounted antennas In addition, cellular telephones are common targets for thieves, and the cellular antenna is literally a flag directing potential thieves to the desired vehicles.

It is desirable to retract a radio antenna into the body of the vehicle so as to leave the vehicle's lines clean and streamline when the radio is not in use. Retractable antennas are also desirable since the antennas, if they are not retractable, are commonly damaged when the vehicle passes through a car wash. Electrically powered mechanisms for retracting AM/FM radio antennas have become quite common on most modern vehicles. The same feature would be extremely desirable for a cellular telephone antenna.

It is also desirable to provide a single multiband antenna which can handle both the AM/FM commercial broadcast frequencies and the cellular telephone frequencies. Multiband antennas have been provided for use with citizen band (CB) radios as illustrated in U.S. Pat. Nos. 4,095,229 and 4,325,069. Such antennas may be coupled through a single feed line to a splitter to separate the AM/FM and citizen band (CB) radio frequencies. In other situations, a loading coil is provided on the antenna itself to produce an effective length suitable for transmission and reception of the desired frequency band.

Retractable triband antennas for the AM/FM bands and the cellular telephone band are disclosed in U.S. Pat. Nos. 4,647,941; 4,658,260; 4,675,687; 4,721,965; 4,748,450 and 4,847,629.

The numerous devices of the prior art provide triband antennas for AM/FM reception and cellular telephone service; however, in general the prior art antennas exhibit a high voltage standing wave ratio (VSWR), poor isolation between the cellular and AM/FM antenna portions, a radiation pattern off the horizontal axis, poor impedance and pattern bandwidth.

SUMMARY OF THE INVENTION

The present invention contemplates a multiband antenna comprising a typical AM/FM tubular antenna terminating at its distal end with a center-fed coaxial dipole antenna for the cellular band. The feedline for the cellular antenna extends through the tubular AM/FM antenna.

In the present invention, the antenna is telescoping, with at least two lower members forming the AM/FM antenna measuring approximately twenty-three inches (23") in length and the uppermost member forming the cellular antenna. The feedline for the cellular antenna also serves to couple mechanical extension and retraction forces to the telescoping sections of the antenna.

Importantly, the retractable antenna of the present invention has a carefully designed slip ring rotary connection which transfers a coaxial input signal from the retractable cable to a coaxial connector connected to a transceiver such as a cellular telephone. The rotary connector is impedance matched with the rest of the transceiver system to maintain minimum VSWR.

A primary objective of the present invention is to provide a retractable triband antenna for AM/FM radio and cellular telephone bands.

Another objective of the present invention is to provide a retractable triband antenna having a rotary connection that exhibits a very low broadband VSWR at RF frequencies.

An additional objective of the present invention is to provide a retractable triband antenna wherein there is minimal coupling between the cellular portion and the AM/FM antenna portion.

A further objective of the present invention is to provide a retractable triband antenna that is economically fabricated and will enjoy a long life in operation.

Our invention will be fully understood when reference is made to the following detailed description taken in conjunction with the accompanying drawings.

DETAILED DESCRIPTION OF THE INVENTION

Figure 1:
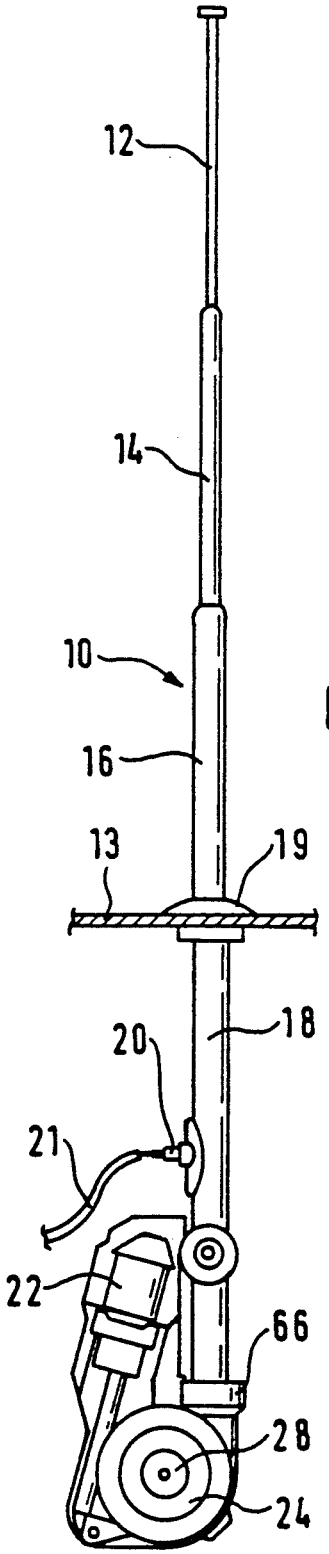
FIG. 1 is a front view of an extended telescoping antenna in accordance with the present invention.

FIG. 1 illustrates a telescoping collapsible triband antenna 10 including at least three coaxially arranged sections 12, 14 and 16 forming an antenna mast which may be retracted into a base section 18 which is typically mounted beneath a surface 13 of a vehicle. Mounting apparatus 19 is provided on the top of section 18 for mounting the antenna to the vehicle surface 13. A stud 20 is provided for coupling sections 14 and 16 to a suitable AM/FM band radio receiver via a cable 21. An electric motor 22 such as a twelve-volt DC motor is provided for actuating a reel or spool mechanism provided in a housing 24 to extend or retract a coaxial cable 26 shown in FIG. 2. The coaxial cable 26 extends through base section 18 and sections 14 and 16 of the AM/FM antenna and is connected to antenna section 12 which forms a cellular telephone antenna.

Figure 2:
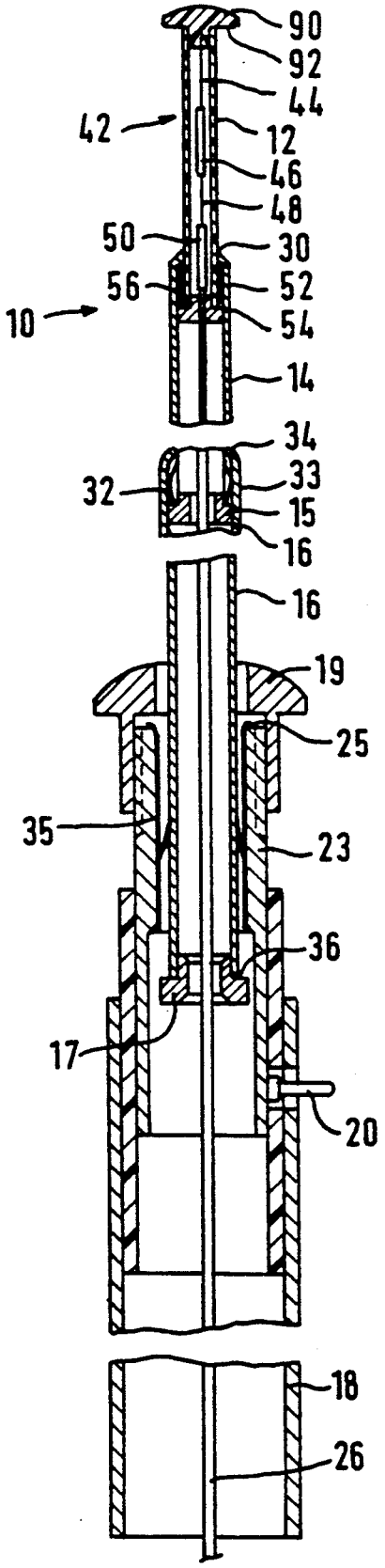
FIG. 2 is a vertical section of the antenna portion of the telescoping antenna of FIG. 1.

Referring to FIG. 2, there is shown a collapsible telescoping antenna 10 having at least three telescopingly arranged sections 12, 14 and 16 forming the antenna mast. Sections 14 and 16 are preferably formed of brass or stainless steel tubes which may be plated on the exterior surface for ornamental and corrosion-resistance purposes. Both sections 14 and 16 have their upper ends rolled inwardly and their lower ends terminated by shouldered bushings 15 and 17 respectively. Bushings 15 and 17 function to guide sections 14 and 16 and form an interference fit and stop the travel of the telescoping members when the antenna is fully retracted. The upper end of section 14 is rolled inwardly at 30 and at the lower end bushing 15 has a shoulder 32. Section 16 is rolled inwardly at 34 and bushing 17 has a shoulder 36. Alignment spring sleeves 33 and 35 are disposed about sections 14 and 16 adjacent bushings 15 and 17 respectively. The spring sleeves 33 and 35 function to center the sections coaxially and also to make electrical contact from section 14 to section 16 and from section 16 to a conductive sleeve 23 mounted inside of base section 18, which is in contact with the stud 20.

When the antenna is being extended, the spring sleeve 33 engages section 16 at 34 and spring sleeve 35 engages a shoulder 25 that is part of mounting apparatus 19 to limit the upwardly travel of sections 14 and 16. When the antenna is being retracted, an insulated radome adaption 54 engages bushing 15 which further engages bushing 17 to retract the antenna sections.

Section 12 is formed of a fiberglass material and functions as a radome in which the cellular antenna portion is mounted. The cellular antenna comprises the center-fed half-wave dipole antenna 42 consisting of a whip portion 44 and a coaxial skirt 46. The dipole is fed by a 50-ohm micro-coax feed line rod 48 which extends upwardly through the skirt 46 of the dipole antenna. A coaxial choke 50 is formed at the base of the dipole antenna coaxially with and surrounding the micro-coax feed line rod 48. The feed line rod 48 is terminated at the base of the dipole antenna by a transformer 52 and the insulated radome adapter 54 which is slideably fitted inside section 14. A spring alignment sleeve 56 is disposed about the radome and extends outwardly from the surface thereof to engage section 14. Alignment sleeve 56 assures that the fiberglass radome is centered within section 14 and is coaxial therewith. Sleeve 56 is not for electrical contact, since the radome is fiberglass.

At the transformer 52 and the adapter 54, the micro-coax feed line rod 48 is electrically connected to cable 26 through the transformer 52 for feeding the cellular signals to the cellular antenna. In addition, as previously discussed, cable 26 functions to transfer the mechanical forces for extending and retracting the antenna sections of the collapsible antenna.

The details of the configuration for the antenna design can be found in a patent application entitled MULTIBAND ANTENNA filed July 3, 1990 as Ser. No. 07/547993 by inventors George D. Yarsunas, Michael L. Brennan and James R. Hendershot.

Figure 4:
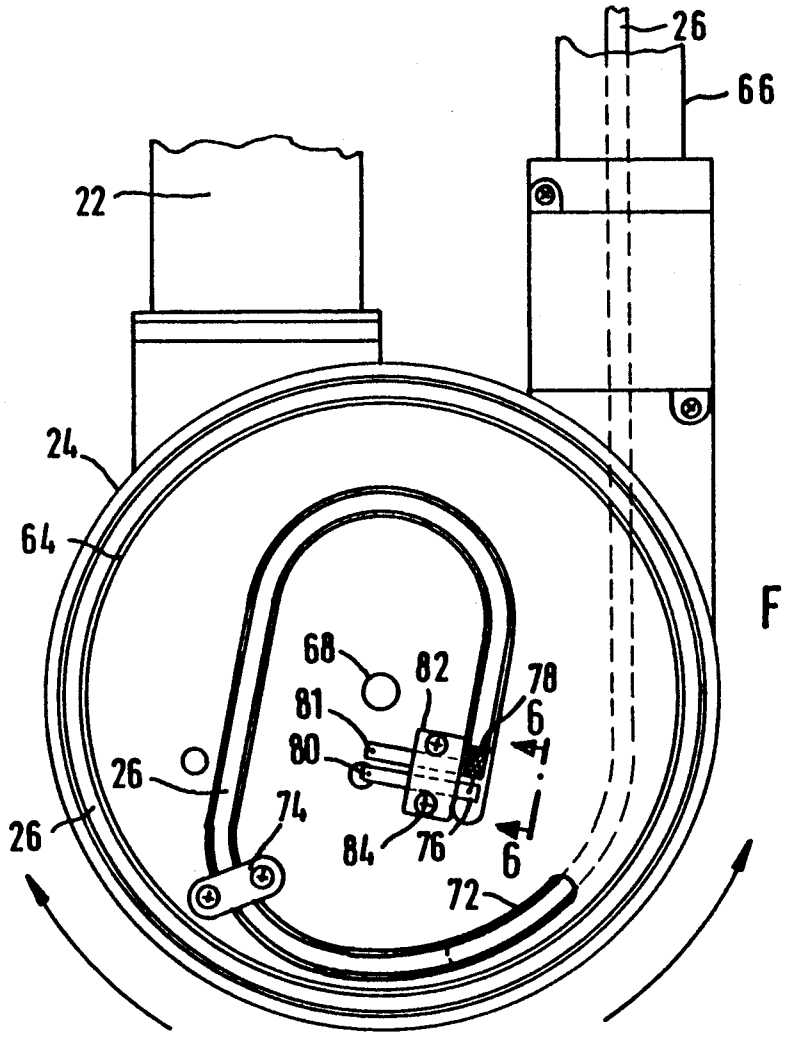
FIG. 4 and 5 are views taken along the 4—4 line and 5—5 line of FIG. 3, respectively.
Figure 3:
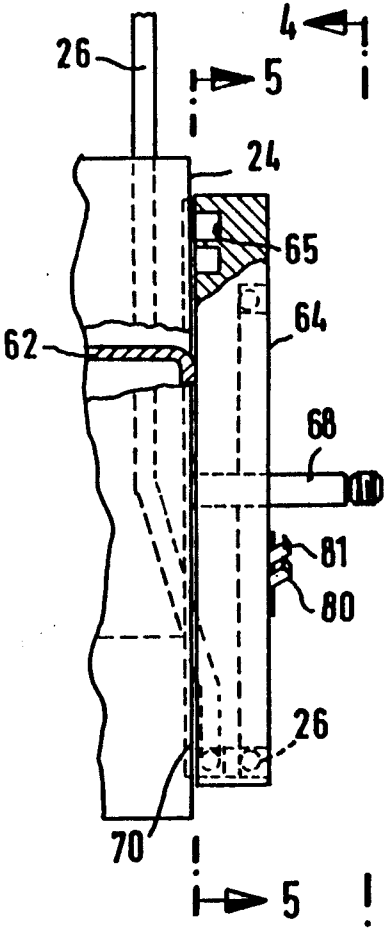
FIG. 3 is a side elevational view of the drive portion of the triband antenna of the present invention with its cover removed and portions broken away to reveal internal structure.
Figure 5:
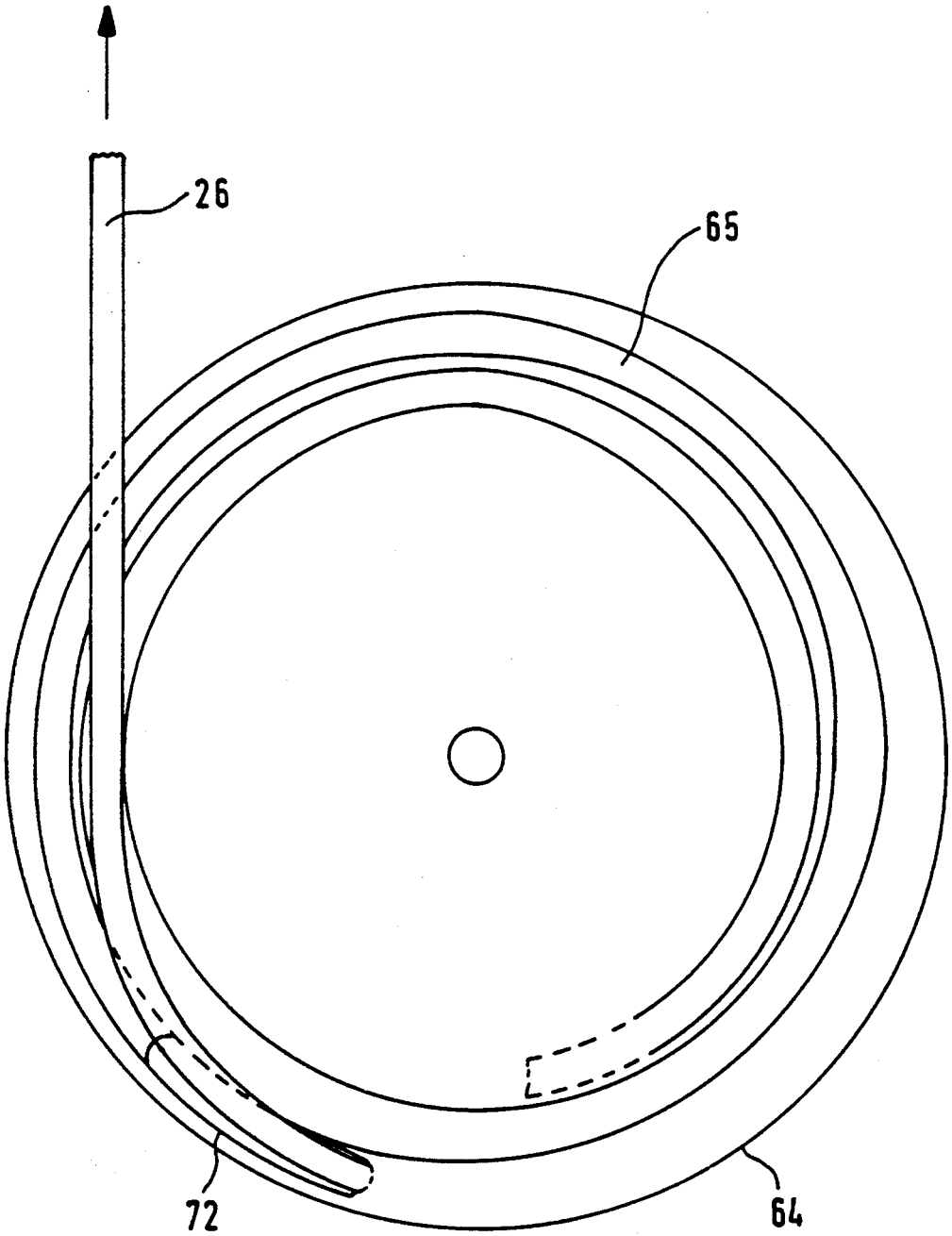

Turning now to FIGS. 3-5 therein is illustrated the drive portion of the motorized antenna. The housing 24 is conventional in design and includes a motor portion 22 and a spool holder 62. The spool holder 62 is in the form of a receptacle dimensionally sized to accept a cable take up/drive spool 64 thereon. The cable take up/drive spool 64 has a spirodal cable groove 65 upon which is wound the coaxial fifty ohm drive cable 26. As the cable 26 comes off the spool 64, it extends through the housing 24 and an antenna mounting stud 66 and into the retractable antenna 10 as shown in FIG. 1. During the extension and retraction of the antenna 10, the spool 64 is rotatably driven around pin 68 by the electric motor 22 through an appropriate power drive mechanism (not shown) such as a gearing assembly. A cable support plate 70 (shown in dotted line in FIG. 3) rides against the coaxial cable 26 between the bottom of the spool 64 and the housing 24 to keep the coaxial cable 26 in the proper alignment on the spool 64.

Figure 6:
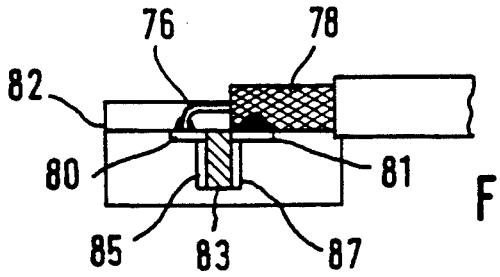
FIG. 6 is a view taken along the 6—6 line of FIG. 4 showing the connection of the spring contacts to the output coaxial cable.
Figure 7:
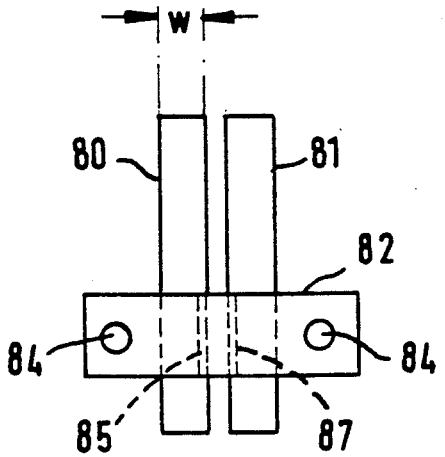
FIG. 7 is an elevational view of the spring contacts found in the drive portion of the antenna of the present invention.
Figure 8:
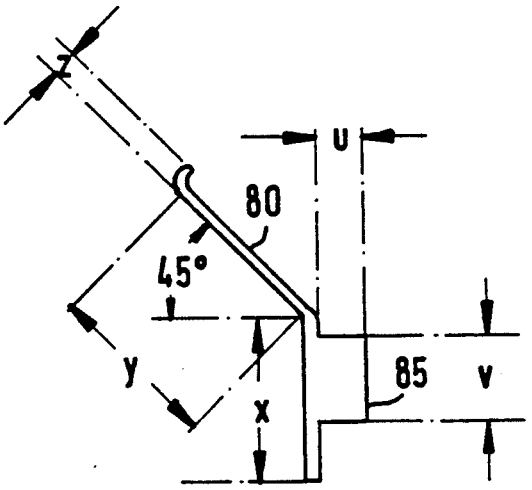
FIG. 8 is a side view of one of the spring contacts of FIG. 6.
Figure 9:
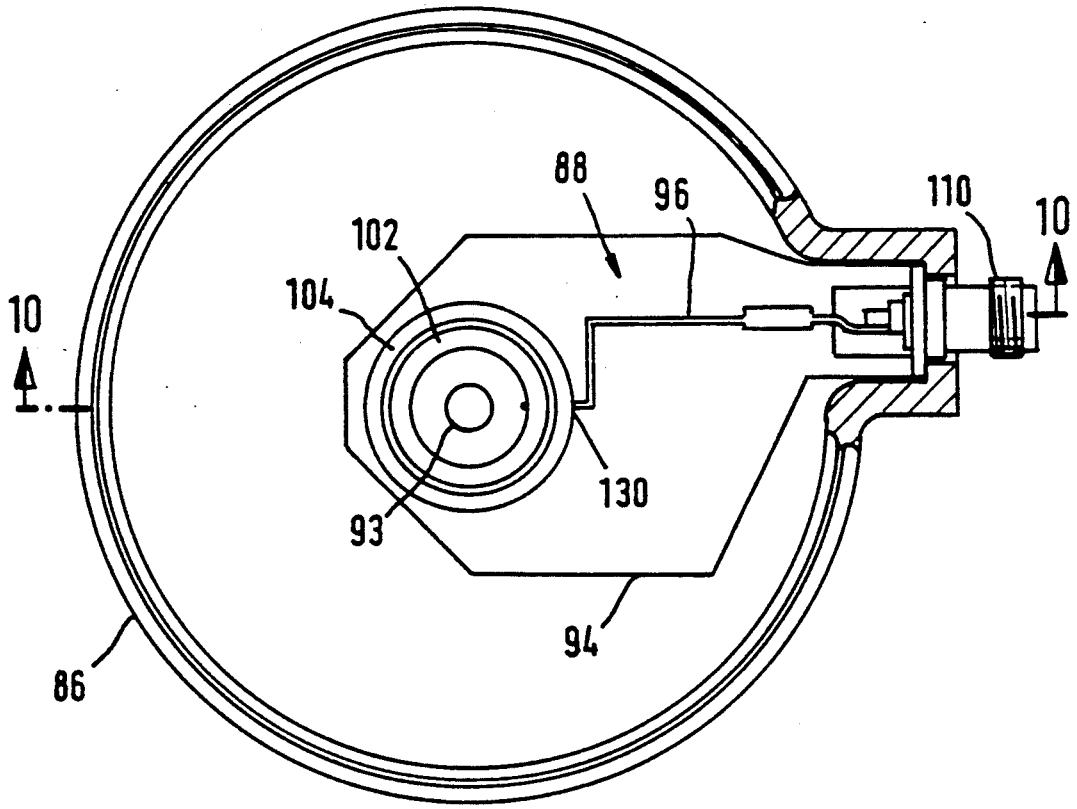
FIG. 9 is an elevational view of the cover for the drive housing.
Figure 10:
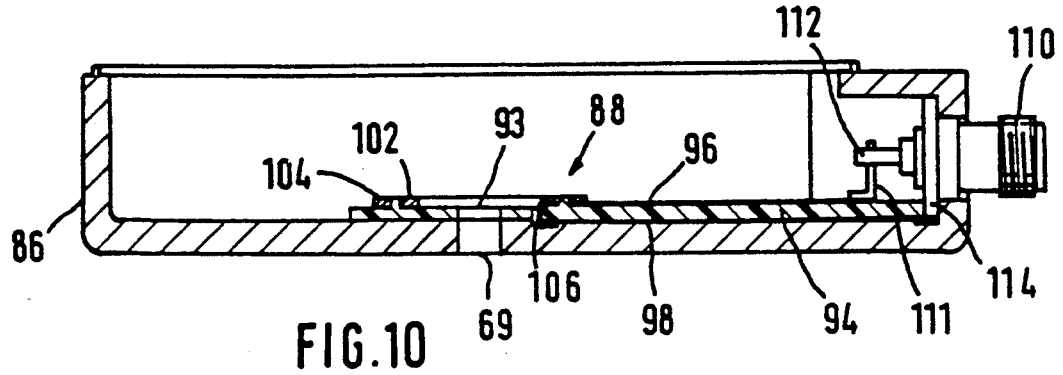
FIG. 10 is a sectional view of the housing cover taken along the 10—10 line of FIG. 9.

The end of the coaxial cable 26 extends through an opening 72 on the inner wall of the spool 64 and is held in place by a strain relief cable clamp 74 designed to permit limited lateral movement of the coaxial cable 26 in order to limit strain thereon. The end of the coaxial cable 26 is stripped to expose its central conductor 76 and braided portion 78. As best seen in FIGS. 4 and 6, the central conductor 76 and braided portion 78 are separately welded or soldered to the terminal ends of spring clips 80 and 81, respectively. The spring clips 80 and 81 are electrically isolated from one another by spacer 83 of epoxy G10 fiberglass (or an equivalent dielectric moldable material) and spool 64 by a retainer 82 and screws 84. Each spring clip 80 and 81 is made of spring temper metal (such as 0.006" thick beryllium copper alloy), which may be plated for conductivity and/or wear resistance, and is bent to have a profile as shown in FIG. 7 and 8 so as to be cantilevered from the retainer 82. Each spring clip 80, 81 is provided with a pad 85, 87, which is bent ninety degrees (90°) to the spring plane. The pads 85, 87 help form a matched transmission line connecting the feed cable 26 through the spring clips 80, 81 to the remainder of the transmission system.

Figure 12:
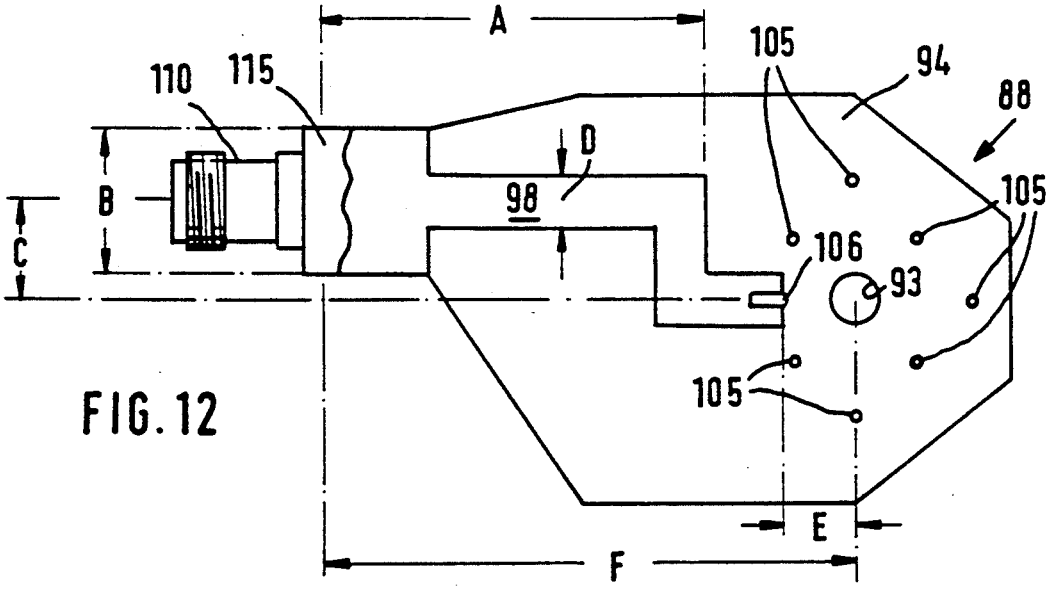
FIGS. 12, 13 and 14 are various views of the ring connector circuit ready for insertion in the cover of FIG. 9.
Figure 13:
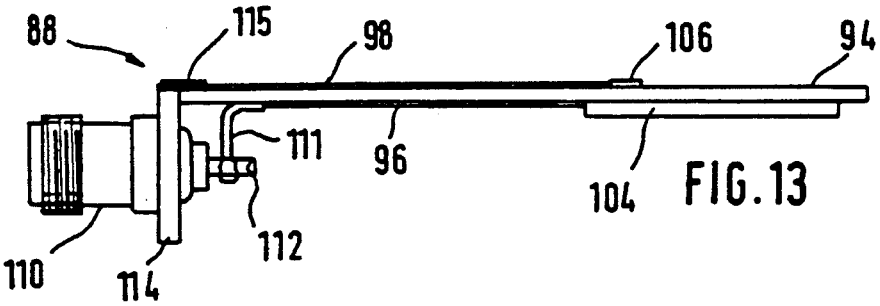
Figure 14:
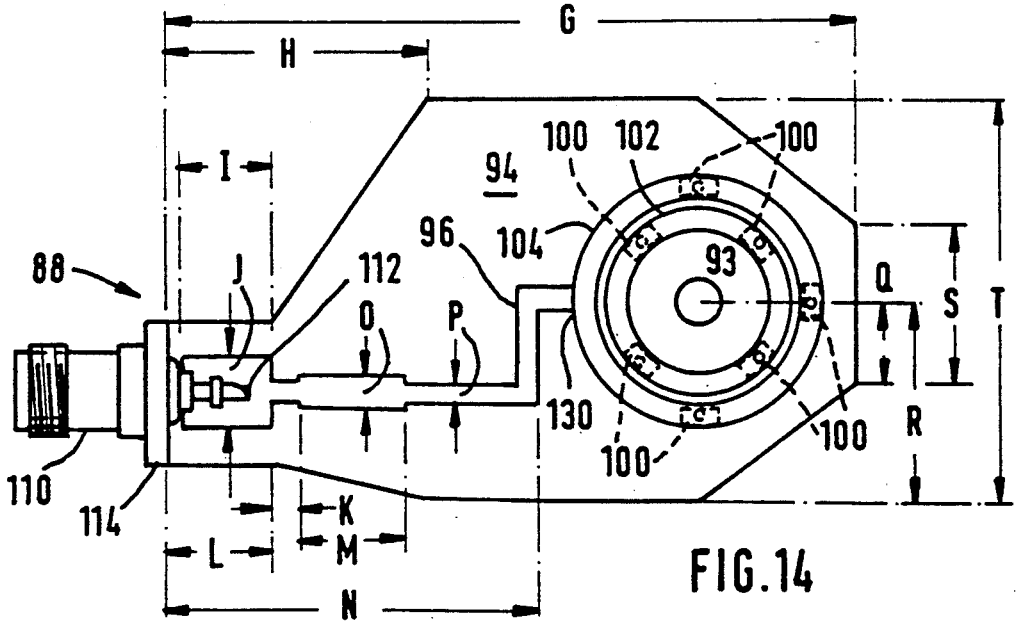

A cover 86 is designed to interfit with the housing 24 and has a ring connector circuit generally indicated by numeral 88. The ring connector circuit 88 is carefully designed to lie flush within the housing cover 86 and must be impedance matched over a broad band with the remainder of the antenna system so as to possess a low VSWR at RF frequencies. The cover 86 and the ring connector circuit 88 are provided with clearance apertures 69 and 93, respectively, for the pin 68. As best seen in FIGS. 12 through 14, the ring connector circuit 88 is provided by a printed circuit board having a base 94 of epoxy G10 fiberglass or an equivalent dielectric moldable material with printed circuits 96 and 98 made of 0.0014 inch copper (may be plated with at least 0.0003 inch tin-lead plating with fifty to seventy percent (50 to 70%) tin) on opposite sides of the base 94. The plated copper is provided in a circular patch pattern forming seven copper attachment pads 100 on the upper side of base 94.

Soldered to the attachment pads 100 are inner and outer slip rings 102 and 104 made from 0.062" thick copper or brass with 0.0003–0.005" thick nickel plating. The solder has been dripped through apertures 105 (FIG. 12) in the base 94 thereby attaching the slip rings 102, 104 to the pads 100. The inner ring 102 has an outer diameter of 0.940" and an inner diameter of 0.724" with a width of 0.108" while the outer ring 104 has an outer diameter of 1.226" and an inner diameter of 1.010" with a width of 0.108" whereby a gap of 0.035" is maintained between them. The outer ring 104 is electrically connected to the top printed circuit 96 through its solder attachment at feed point 130 while the inner ring 102 is electrically connected to the bottom printed circuit 98 by a 20 gauge wire 106 extending through a clearance hole in the printed circuit board base 94 and being soldered in a bridging relationship to the bottom printed circuit 98 and inner ring 102.

At the end of the ring connector circuit 88 opposite the inner and outer slip rings 102, 104 is a TNC coaxial panel receptacle 110 which is adapted for connection to a coaxial cable lead for a transceiver such as a cellular telephone. The panel receptacle 110 is attached to the ring connector circuit 88 by soldering its center pin 112 to the top printed circuit 96 via an attachment lead wire 111 of #18 gauge tinned copper wire and soldering its flange 114 to the bottom printed circuit 98 via solder patch 115. The end result is that the top printed circuit 96 connects the outer ring 104 to the center pin 112 and the bottom printed circuit 98 connects the inner ring 102 to the TNC flange 114.

The final dimensions for the circuit to achieve the desired fifty ohm impedance match with the antenna are obtained by fine tuning during testing. This results in the following dimensions for the ring connector circuit 88 as referenced in FIGS. 12 through 14:

| Reference Letter | Inches | Reference Letter | Inches |
|---|---|---|---|
| A | 1.850 | M | .500 |
| B | .687 | N | 1.775 |
| C | .468 | O | .150 |
| D | .250 | P | .100 |
| E | .348 | Q | .375 |
| F | 2.560 | R | .960 |
| G | 3.298 | S | .750 |
| H | 1.235 | T | 1.920 |

-continued

| Reference Letter | Inches | Reference Letter | Inches |
|---|---|---|---|
| I | .437 | | |
| J | .338 | | |
| K | .140 | | |
| L | .510 | | |

The preliminary design for the ring connector circuit 88 (including rings 102, 104; printed circuits 96, 98; spring clips 80, 81; and pads 85, 87) is in accordance with formulas from Antenna Engineering Handbook by Henry Jasik, Page 30–15.

Design of Rings 102, 104

$$Z_o = \frac{257}{\sqrt{E}\,\mathrm{Log}\left(4 + \frac{8W}{s}\right)} \quad \text{for } s << w$$

where:

w=width of inner and outer rings 102, 104=0.108"

s=gap between inner and outer rings 102, 104=0.035"

$$Z_o = \frac{257}{\sqrt{E}\,\mathrm{Log}\,(28.68)} = \frac{176.3}{\sqrt{E}}$$

For free space, E=1.0 so $Z_o$=176.3Ω.

For printed circuit board 94 , E=4.8 so $Z_o$=80.5Ω.

The effective E for placing inner and outer rings 102, 104 on the printed circuit board 94 appears to be 3.1 so $Z_o$=100Ω.

Since the inner and outer rings 102, 104 are two transmission lines in parallel from the spring clips 80, 81 to the printed circuit 96 or 98:

$$Z_T = (Z_1\,Z_2)/(Z_1 + Z_2) = \frac{100 \times 100}{100 + 100} = 50\Omega$$

Design of Printed Circuits 96, 98

$$Z_o = \frac{377\,h}{\sqrt{E}\,w} \quad \text{for } h << w$$

where w=width of the printed circuit 96 or 98 h=thickness of printed circuit board 94=0.062"

E=4.8 (for circuit board 94)

$Z_o$50Ω

$$\text{Therefore: } w = \frac{377\,(.062)}{\sqrt{4.8}\,(50)} = .213''$$

This width was reduced to 0.150" to account for fringing effects. During testing it was further reduced to 0.100" to fine tune the circuit.

Design for Spring Clips 80, 81

$$Z_o = \frac{257}{\sqrt{E}\,\log\left(4 + \frac{8w}{s}\right)} \quad \text{for } s << w$$

A gap (s) of 0.035" to 0.040" is desirable to prevent voltage breakdown and ease manufacturability.

where:

s=gap between spring clips 80, 81=0.040"

E=1.0 (for free space)
w=width of spring clips 80, 81=0.135"

$$Z_o = \frac{257}{\sqrt{E}\log(17.5)} = 206\Omega$$

This large mis-match was reduced by the addition of contact pads 85, 87.

Design of Pads 85, 87 on Spring Clips 80, 81

$$Z_o = \frac{377\,s}{\sqrt{E}\,w} \qquad \text{for } s << w$$

where:
s=gap between adjacent pads 85, 87=0.040"
w=width of the pads 85, 87=0.125"
E=4.8 (for circuit board 94)

$$Z_o = \frac{377\,(.040)}{\sqrt{4.8}\,(.125)} = 55.08\Omega$$

After fine tuning and testing, the desired fifty ohm impedance in the spring clips 80, 81 was achieved using the following dimensions found in FIGS. 7–8:

| Reference Letter | Inches |
|---|---|
| U | .150 |
| V | .300 |
| W | .110 |
| X | .460 |
| Y | .317 |
| Z | .0625 |

Figure 11:
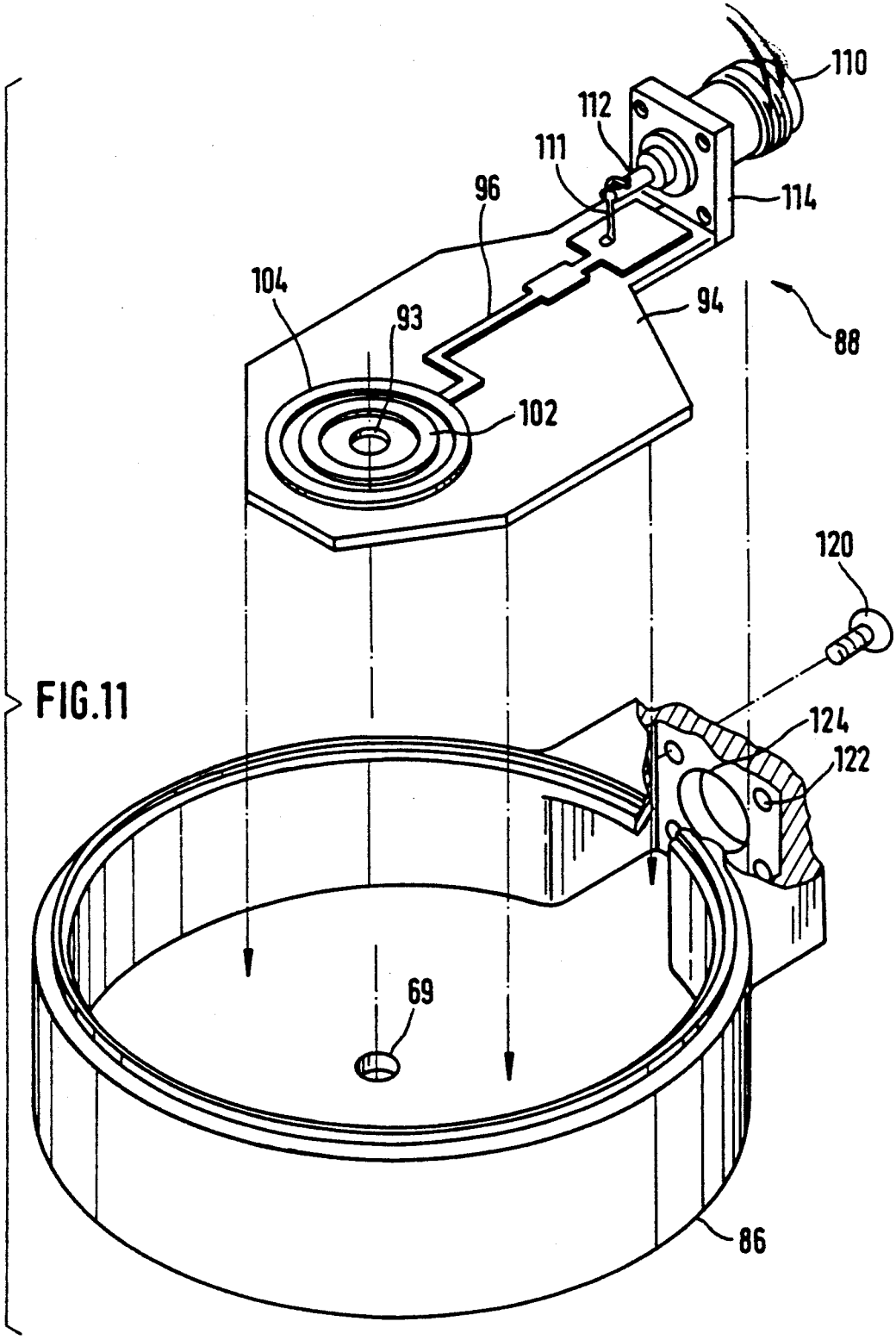
FIG. 11 is an exploded view of the cover of FIG. 9.

The ring connector circuit 88 can be inserted into the housing cover 86 as shown in FIG. 11. The appropriately dimensioned housing cover 86 permits the ring connector circuit 88 to fit snugly therein where it is attached by epoxy and four screws 120 (only one shown) through apertures 122. The panel receptacle 110 fits neatly into aperture 124.

Figure 15:
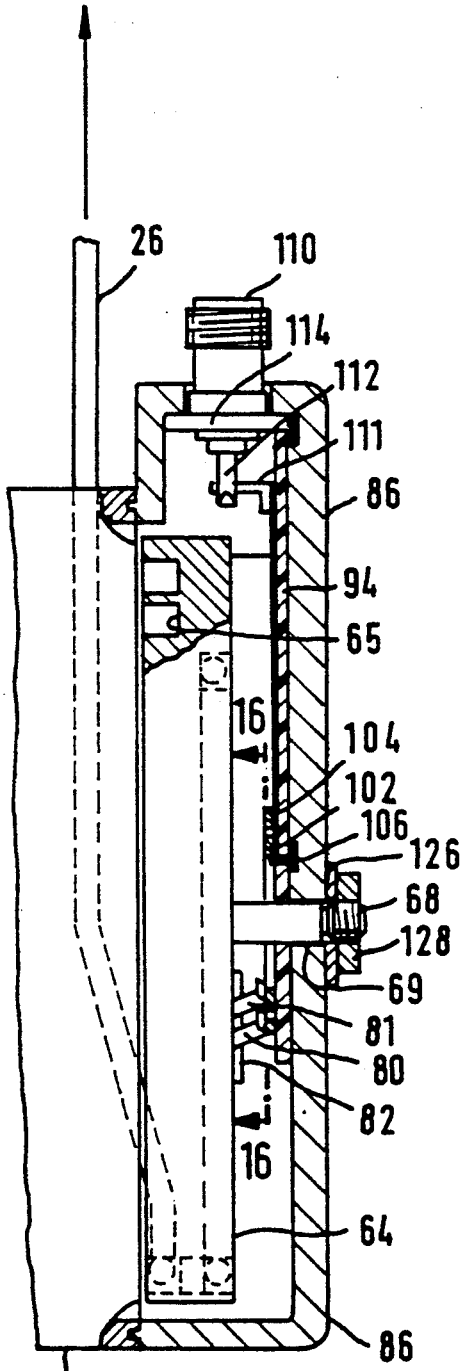
FIG. 15 is a side elevational view similar to FIG. 3 but with the cover in place.
Figure 16:
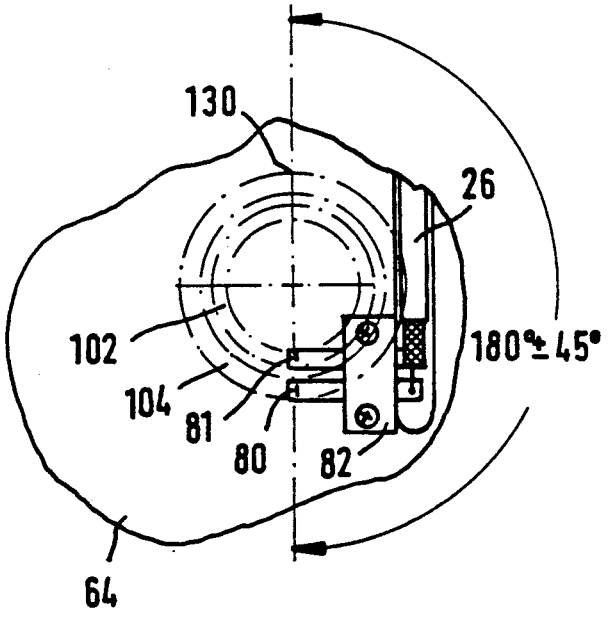
FIG. 16 is a view taken along the 16—16 line of FIG. 15.

Turning now to FIGS. 15 and 16, the housing cover 86 is dimensionally sized to interfit with the housing 24 to form an enclosure. The pin 68 carrying the spool 64 extends into aperture 69 in a mating relationship when the cover 86 is seated on the housing 24. The cover 86 is held in assembly with the housing 24 by a washer 126 and a nut 128 threadedly retained on the end of the pin 68. The spring clips 80 and 81 extend from the spool 64 into housing cover 86, so the free ends of the spring clips 80 and 81 are biased into engagement with the ring connector circuit 88 found with the housing cover 86.

To prepare the antenna 10 for operation, the housing cover 86 is placed on the housing 24 so the spring clips 80 and 81 come into contact with the outer ring 104 and the inner ring 102, respectively. The natural resilient memory of the spring clips 80 and 81 maintain the desired electrical contact with the inner and outer rings 102 and 104. As the electric motor 22 is operated to extend and retract the antenna, the spool 62 will rotate relative to the ring connector circuit 88. However, because of the spatial relationship between the spring clips 80, 81 and the ring connector circuit 88, the spring clips 80, 81 continually complete an electrical circuit between the coaxial cable 26 and the ring connector circuit 88 during the extension and retraction process. To provide the desired impedance matching in the fully extended position, the point of contact between the spring clips 80 and 81 and the ring connector circuit 88 must be 180°±45° opposite the feed point 130 as shown in FIG. 16.

Figures 17, 18, 19:
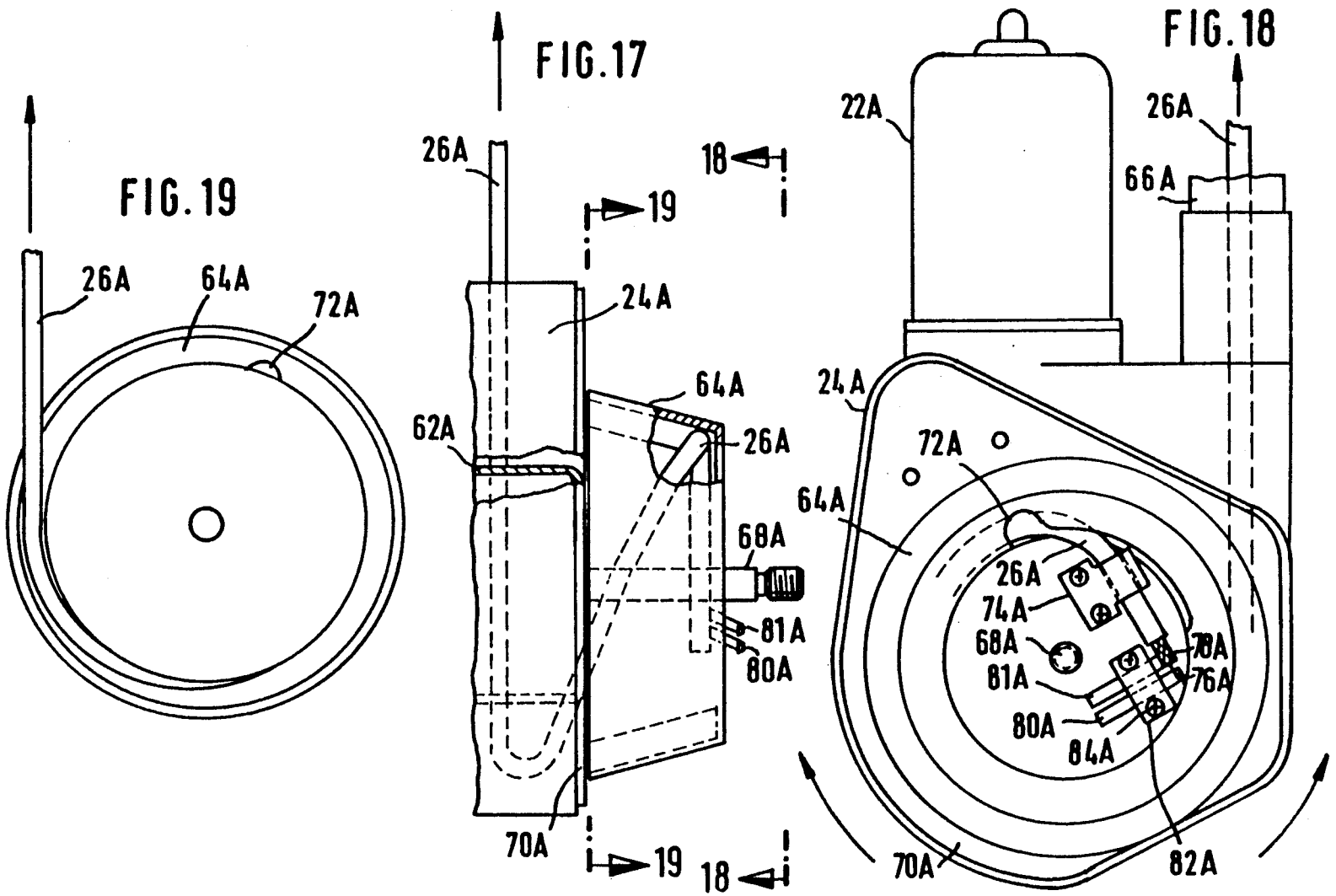
FIG. 17 is a side elevational view of the drive portion of a second embodiment of the triband antenna of the present invention with its cover removed and portions broken away to reveal internal structure.
FIGS. 18 and 19 are views taken along the 18—18 line and 19—19 line of FIG. 17, respectively.
Figure 20:
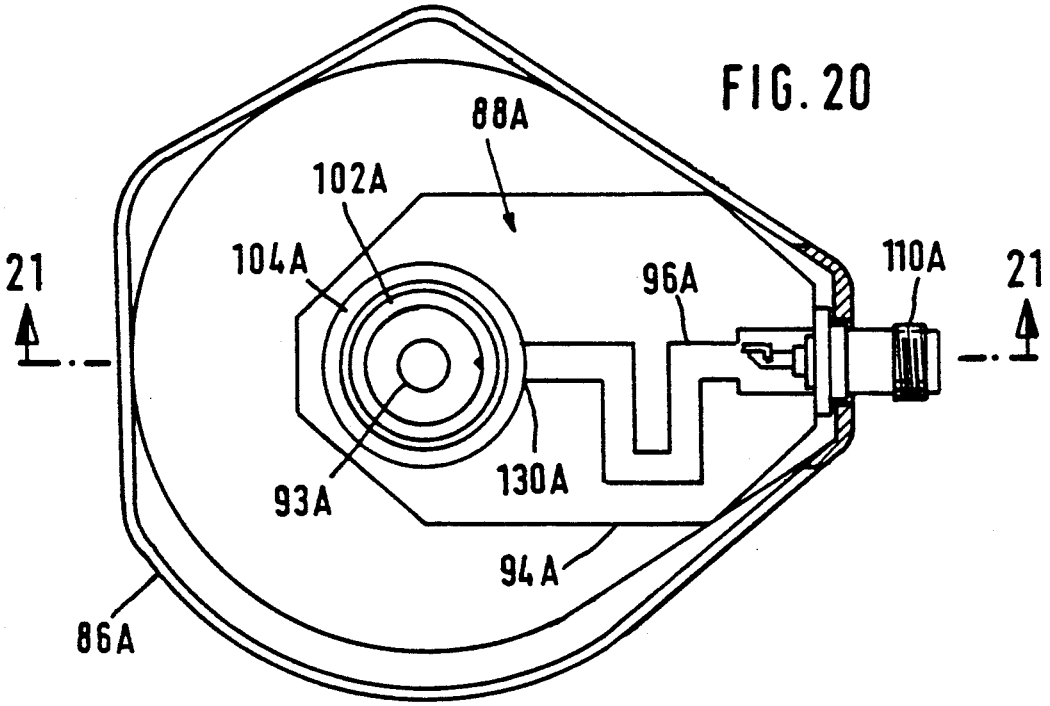
FIG. 20 is an elevational view of the cover for the drive housing of the second embodiment.
Figure 21:
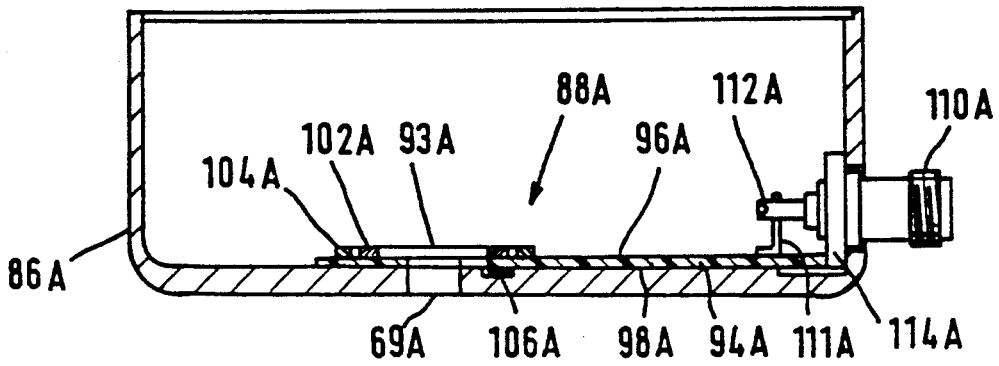
FIG. 21 is a sectional view of the housing cover of the second embodiment taken along the 21—21 line of FIG. 20.

With reference to FIGS. 17–19 therein is illustrated the drive portion of a second embodiment of the motorized antenna of the present invention. The housing 24A is conventional in design and includes a motor portion 22A and a spool holder 62A. The spool holder 62A is in the form of a receptacle dimensionally sized to accept a cable take up/drive spool 64A thereon. The cable take up/drive spool 64A has a trapezoidal shape and a coaxial fifty ohm drive cable 26A. As the cable 26A comes off the spool 64A, it extends through the housing 24A and an antenna mounting stud 66A and into a retractable antenna identical to the retractable antenna I? shown in FIG. 1. During the extension and retraction of the antenna, the spool 64A is rotatably driven around pin 68A by the electric motor 22A through an appropriate power drive mechanism (not shown) such as a gearing assembly. A cable support plate 70A (shown in FIG. 17) rides against the coaxial cable 26A between the bottom of the spool 64A and the housing 24A to keep the coaxial cable 26A in the proper alignment on the spool 64A.

The end of the coaxial cable 26A extends through an opening 72A on the inner wall of the spool 64A and is held in place by a strain relief cable clamp 74A designed to permit limited lateral movement of the coaxial cable 26A in order to limit strain thereon. The end of the coaxial cable 26A is stripped to expose its central conductor 76A and braided portion 78A. As best seen in FIG. 18, the central conductor 76A and braided portion 78A are separately welded or soldered to the terminal ends of spring clips 80A and 81A, respectively. The spring clips 80A and 81A are also electrically isolated from one another by spacer (not shown but similar to space 83 shown in FIG. 6) of epoxy G10 fiberglass or an equivalent dielectric moldable material and are held to spool 64A by a retainer 82A and screws 84A. Each spring clip 80A and 81A is made of spring temper metal, which may be plated for conductivity and/or wear resistance, and is bent to have a profile (similar to that shown in FIG. 7) so as to be cantilevered from the retainer 82A.

Figure 23:
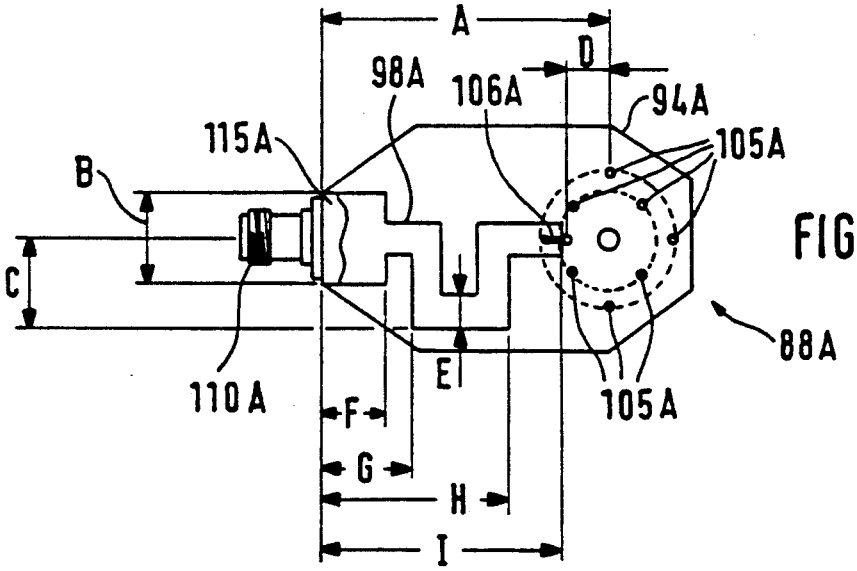
FIG. 23, 24 and 25 are various views of the ring connector circuit ready for insertion in the cover of FIG. 20.
Figure 24:
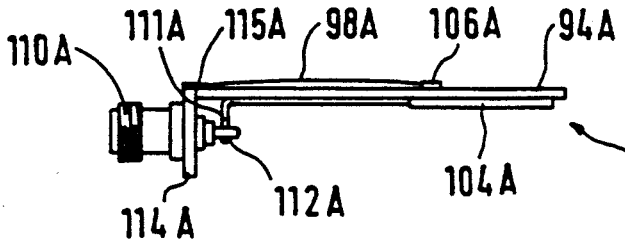
Figure 25:
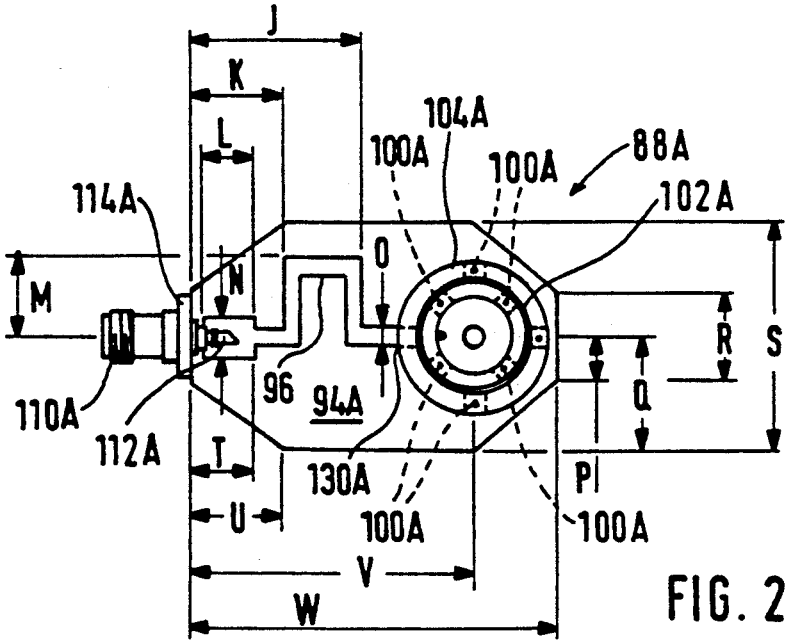

A cover 86A is designed to interfit with the housing 24A and has a ring connector circuit generally indicated by numeral 88A. The ring connector circuit 88A is carefully designed to lie flush within the housing cover 86A and must be impedance matched over a broad band with the remainder of the antenna system so as to possess a low VSWR at RF frequencies. The cover 86A and the ring connector circuit 88A are provided with clearance apertures 69A and 93A, respectively, for the pin 68A. As best seen in FIGS. 23 through 25, the ring connector circuit 88A is provided by a printed circuit board having a base 94A of epoxy G10 fiberglass or an equivalent dielectric moldable material with printed circuits 96A and 98A made of 0.0014 inch copper (may be plated with at least 0.0003 inch tin-lead plating with fifty to seventy percent (50 to 70%) tin) on opposite sides of the base 94A. The plated copper is provided in a circular patch pattern forming seven copper attachment pads 100A on the upper side of base 94A.

Soldered to the attachment pads 100A are inner and outer slip rings 102A and 104A made from 0.062" thick copper or brass with 0.0003–0.005" thick nickel plating. The solder has been dripped through apertures 105A (FIG. 23) in the base 94A thereby attaching the slip rings 102A, 104A to the pads 100A. The inner ring 102A has an outer diameter of 0.940" and an inner diameter of 0.724" with a width of 0.108" while the outer ring 104A has an outer diameter of 1.226" and an inner diameter of 1.010" with a width of 0.108" whereby a gap of 0.035" is maintained between them. The outer ring 104A is electrically connected to the top printed circuit 96A through its solder attachment at feed point 130A while the inner ring 102A is electrically connected to the bottom printed circuit 98A by a 20 gauge wire 106A extending through a clearance hole in the printed circuit board base 94A and being soldered in a bridging relationship to the bottom printed circuit 98A and inner ring 102A.

At the end of the ring connector circuit 88 opposite the inner and outer slip rings 102A, 104A is a TNC coaxial panel receptacle 110A which is adapted for connection to a coaxial cable lead for a transceiver such as a cellular telephone. The panel receptacle 110A is attached to the ring connector circuit 88A by soldering its center pin 112A to the top printed circuit 96A via an attachment lead wire 111A of #18 gauge tinned copper wire and soldering its flange 114A to the bottom printed circuit 98A via solder patch 115A. The end result is that the top printed circuit 96A connects the outer ring 104A to the center pin 112A and the bottom printed circuit 98A connects the inner ring 102A to the TNC flange 114A.

The dimensions for the circuit 88A are designed in accordance with the previously discussed formulas from the Antenna Engineering Handbook to achieve the desired fifty ohm impedance match with the antenna with the final dimensions being obtained by fine tuning during testing. This results in the following dimensions for the ring connector circuit 88A as referenced in FIGS. 23 through 25:

| Reference Letter | Inches | Reference Letter | Inches |
|---|---|---|---|
| A | 2.032 | M | .707 |
| B | .750 | N | .281 |
| C | .782 | O | .100 |
| D | .348 | P | .375 |
| E | .250 | Q | .960 |
| F | .505 | R | .750 |
| G | .712 | S | 1.920 |
| H | 1.327 | T | .505 |
| I | 1.680 | U | .710 |
| J | 1.252 | V | 2.032 |
| K | .787 | W | 2.770 |
| L | .438 | | |

The ring connector circuit 88A is designed in accordance with the previously discussed formulas from Antenna Engineering Handbook by Henry Jasik in a manner similar to the first embodiment.

Figure 22:
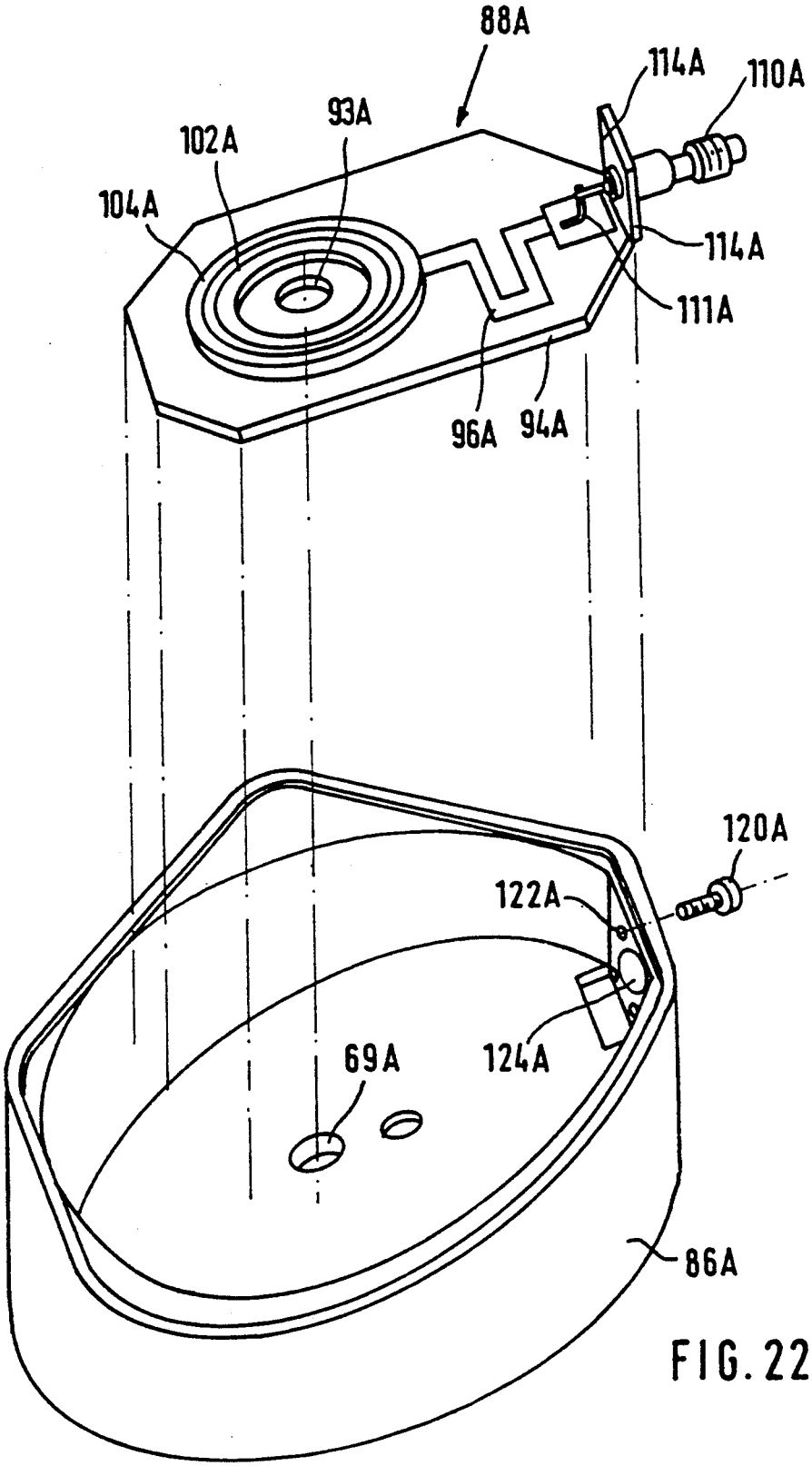
FIG. 22 is an exploded view of the cover of FIG. 20.

The ring connector circuit 88A can be inserted into the housing cover 86A as shown in FIG. 22. The appropriately dimensioned housing cover 86A permits the ring connector circuit 88A to fit snugly therein where it is attached by epoxy and four screws 120A (only one shown) through apertures 122A. The panel receptacle 110A fits neatly into aperture 124A.

Figure 26:
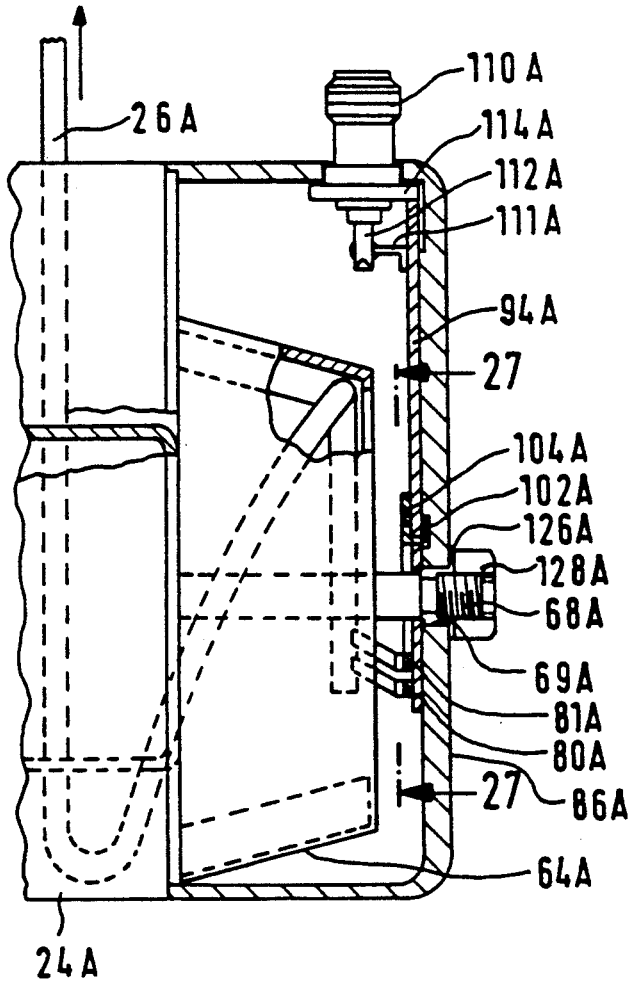
FIG. 26 is a side elevational view of the second embodiment to FIG. 18 but with the cover in place.
Figure 27:
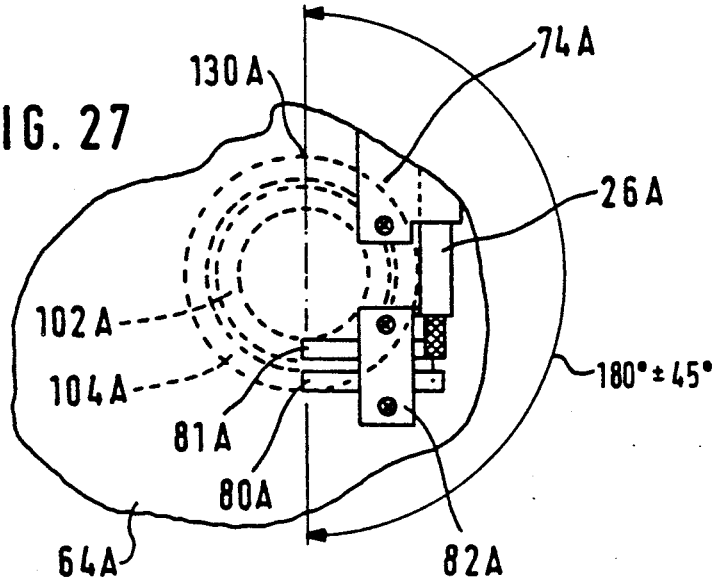
FIG. 27 is a view taken along the 27—27 line of FIG. 26.

Turning now to FIGS. 26 and 27, the housing cover 86A is dimensionally sized to interfit with the housing 24A to form an enclosure. The pin 68A carrying the spool 64A extends into aperture 69A in a mating relationship when the cover 86A is seated on the housing 24A. The cover 86A is held in assembly with the housing 24A by a washer 126A and a nut 128A threadedly retained on the end of the pin 68A. The spring clips 80A and 81A extend from the spool 64A into housing cover 86A, so the free ends of the spring clips 80A and 81A are biased into engagement with the ring connector circuit 88A found with the housing cover 86A.

In operation, the housing cover 86A is placed on the housing 24A so the spring clips 80A and 81A come into contact with the outer ring 104A and the inner ring 102A, respectively. The natural resilient memory of the spring clips 80A and 81A maintain the desired electrical contact with the inner and outer rings 102A and 104A. As the electric motor 22A is operated to extend and retract the antenna, the spool 62A will rotate relative to the ring connector circuit 88A. However, because of the spatial relationship between the spring clips 80A, 81A and the ring connector circuit 88A, the spring clips 80A, 81A continually complete an electrical circuit between the coaxial cable 26A and the ring connector circuit 88A during the extension and retraction process. To provide the desired impedance matching in the fully extended position, the point of contact between the spring clips 80A and 81A and the ring connector circuit 88A must be 180°±45° opposite the feed point 130A as shown in FIG. 27.

Thus, the present invention provides a retractable motorized triband antenna capable of receiving signals in the AM/FM commercial radio bands and receiving and transmitting cellular telephone signals. The antenna has a unique slip ring rotary connection used to transfer the coaxial input signal to an output coaxial connector while maintaining an impedance match and minimum VSWR.

The preferred embodiment described above admirably achieves the objects of the invention; however, it will be appreciated that departures can be made by those skilled in the art without departing from the spirit and scope of the invention which is limited only by the following claims.

What is claimed is:

1. A retractable motorized antenna, comprising:

A. an antenna housing;

B. a high frequency antenna portion telescoping mounted to said housing for radiating and receiving electromagnetic energy in a frequency band, said high frequency antenna portion having a designated impedance;

C. a spool rotatably mounted within said housing;

D. a coaxial cable operationally connected at one end to said high frequency antenna portion for retracting and extending the same and for transferring a high frequency signal therebetween, said coaxial cable being operationally connected at its other end to said spool so as to be wound and unwound thereon during retraction and extension of said high frequency antenna portion, said coaxial cable having an impedance identical to the designated impedance of said high frequency antenna portion;

E. drive means operationally connected to said spool for rotating the same during retraction and extension of said high frequency antenna portion; and F. rotary connector being impedanced matched with said high frequency antenna portion and said coaxial cable and mounted in said housing for transferring a high frequency signal between said coaxial cable and a high frequency transceiver comprising:

i. first and second contacts mounted on said spool for rotation therewith and electrically connected to said coaxial cable, ii. third and fourth contacts mounted on said housing in electrical contact with said first and second contacts respectively on said spool during retraction and extension of said telescoping high frequency antenna portion, and iii. electrical conductor mounted on said housing in electrical contact with said third and fourth contacts for transferring a high frequency signal to a high frequency transceiver.

2. A retractable motorized antenna as described in claim 1, wherein said first and second contacts are spring contacts with natural resiliency biasing said first and second contacts into engagement with said third and fourth contacts.

3. A retractable motorized antenna as described in claim 2, wherein said spring contacts are leaf springs cantilevered from said spool.

4. A retractable motorized antenna as described in claim 1, wherein said first contact is electrically connected to a central conductor of said coaxial cable and said second contact is electrically connected to a braided conductor of said coaxial cable.

5. A retractable motorized antenna as described in claim 1, wherein said third and fourth contacts are slip ring members enabling said first and second contacts to stay in constant contact with said third and fourth contacts during retraction and extension of said telescoping high frequency antenna portion.

6. A retractable motorized antenna as described in claim 5, wherein said electrical conductor is a printed circuit board and said slip ring members are in electrical contact with a printed circuit on said board.

7. A retractable motorized antenna as described in claim 6, wherein said slip ring members are mounted on one side of said board so as to be in contact with said printed circuit.

8. A retractable motorized antenna as described in claim 7, wherein said printed circuit has first and second portions electrically isolated from one another and electrically connected to means for coupling said printed circuit to a high frequency transceiver.

9. A retractable motorized antenna as described in claim 8, wherein said first and second portions of said printed circuit are on opposite sides of said printed circuit board.

10. A retractable motorized antenna as described in claim 9, wherein said slip ring members are inner and outer slip ring members concentrically mounted with respect to one another on said printed circuit board.

11. A retractable motorized antenna as described in claim 10, wherein said inner slip ring member is connected to said first portion of said printed circuit on a lower side of said printed circuit board and said outer slip ring member is connected to said second portion of said printed circuit on an upper side of said printed circuit board.

12. A retractable motorized antenna as described in claim 1, additionally comprising a low frequency antenna portion mounted axially with said high frequency antenna portion and insulated therefrom, said low frequency antenna portion adapted for receiving electromagnetic energy in a frequency band substantially lower than the frequency band of said high frequency antenna portion.

13. An antenna as described in claim 12, wherein said low frequency antenna portion is adapted to receive AM/FM signals.

14. A retractable motorized antenna as described in claim 13, wherein said high frequency antenna portion is adapted to radiate and receive cellular telephone signals.

15. A retractable motorized antenna as described in claim 13, wherein said low frequency antenna portion is formed of a hollow tubular conductive material and is disposed axially with said high frequency antenna portion, said coaxial cable extending through said low frequency antenna portion.

16. A retractable motorized antenna as described in claim 15, wherein said high frequency antenna portion is adapted to be telescopingly received within said low frequency antenna portion, with said coaxial cable providing extending and retracting forces to said high frequency antenna portion.

17. An antenna as described in claim 16, wherein said low frequency antenna portion is formed of telescoping members, at least one of said members also being extended and retracted by forces exerted by said coaxial cable on said high frequency antenna portion.

18. A rotary connector for use in a retractable motorized antenna for connecting a high frequency portion of the antenna to a high frequency transceiver such as a cellular telephone, comprising:

A. a housing;

B. a spool rotatably mounted within said housing;

C. a coaxial cable operationally connected at its one end to said spool so as to be wound and unwound thereon;

D. drive means operationally connected to said spool for rotating the same;

E. first and second contacts mounted on said spool for rotation therewith and electrically connected to said coaxial cable;

F. third and fourth contacts mounted on said housing in electrical contact with said first and second contacts respectively on said spool during rotation of said spool; and G. electrical conductor mounted on said housing in electrical contact with said third and fourth contacts for transferring a high frequency signal to a high frequency transceiver.

19. A rotary connector as described in claim 18, wherein said first and second contacts are spring contacts with natural resiliency biasing said first and second contacts into engagement with said third and fourth contacts.

20. A rotary connector as described in claim 19, wherein said spring contacts are leaf springs cantilevered from said spool.

21. A rotary connector as described in claim 18, wherein said first contact is electrically connected to a central conductor of said coaxial cable and said second contact is electrically connected to a braided conductor of said coaxial cable.

22. A rotary connector as described in claim 18, wherein said third and fourth contacts are slip ring members enabling said first and second contacts to stay in constant contact with said third and fourth contacts during rotation of said spool.

23. A rotary connector as described in claim 22, wherein said electrical conductor is a printed circuit board and said slip ring members are in electrical contact with a printed circuit on said board.

24. A rotary connector as described in claim 23, wherein said slip ring members are mounted on one side of said board so as to be in contact with said printed circuit.

25. A rotary connector as described in claim 24, wherein said printed circuit has first and second portions electrically isolated from one another and electrically connected to means for coupling said printed circuit to a high frequency transceiver.

26. A rotary connector as described in claim 25, wherein said first and second portions of said printed circuit are on opposite sides of said printed circuit board.

27. A rotary connector as described in claim 26, wherein said slip ring members are inner and outer slip ring members concentrically mounted with respect to one another on said printed circuit board.

28. A rotary connector as described in claim 27, wherein said inner slip ring member is connected to said first portion of said printed circuit on a lower side of said printed circuit board and said outer slip ring member is connected to said second portion of said printed circuit on an upper side of said printed circuit board.

* * * * *